United States Patent [19]

Hajianpour

[11] Patent Number: 4,492,222

[45] Date of Patent: Jan. 8, 1985

[54] KNEE EXERCISE MACHINE

[75] Inventor: Mohamad-Ali Hajianpour, Miami Springs, Fla.

[73] Assignee: Diversified Medical Systems, Inc., South Miami, Fla.

[21] Appl. No.: 473,541

[22] Filed: Mar. 9, 1983

[51] Int. Cl.[3] ..... A61H 1/02

[52] U.S. Cl. ..... 128/25 R; 128/49; 128/25 B

[58] Field of Search ..... 128/25 R, 25 B, 84 R, 128/71, 75, 48–51; 272/144

[56] References Cited

U.S. PATENT DOCUMENTS

| | | | |
|---|---|---|---|
| 2,696,206 | 12/1954 | Bierman | 128/51 |
| 2,871,853 | 2/1959 | Demarest et al. | 128/84 R |
| 3,473,528 | 10/1969 | Mishkin et al. | 128/84 R |
| 4,323,060 | 4/1982 | Pecheux | 128/75 |

FOREIGN PATENT DOCUMENTS

| | | | |
|---|---|---|---|
| 2524468 | 12/1976 | Fed. Rep. of Germany | 272/144 |

*Primary Examiner*—Robert A. Hafer
*Assistant Examiner*—Chris Coppens
*Attorney, Agent, or Firm*—Epstein & Edell

[57] ABSTRACT

A knee exerciser cyclically flexes a patient's knee by alternately extending and retracting a leg support having one end disposed behind the knee. The leg support is hinged at one end to a thigh support and is fixed at its other end to a motor assembly. The motor assembly pivots relative to a frame. The other end of the thigh support is also pivotally secured to the frame. The leg support includes a tubular member secured to the thigh support hinge and a screw which is rotatably driven by the motor and is threadedly engaged in the tube. Rotation of the screw extends and retracts the leg support, thereby moving the leg/thigh hinge to cyclically flex the knee joint. The motor is controllable to set the limit point of the flexure cycle and to control the speed of the motor.

15 Claims, 12 Drawing Figures

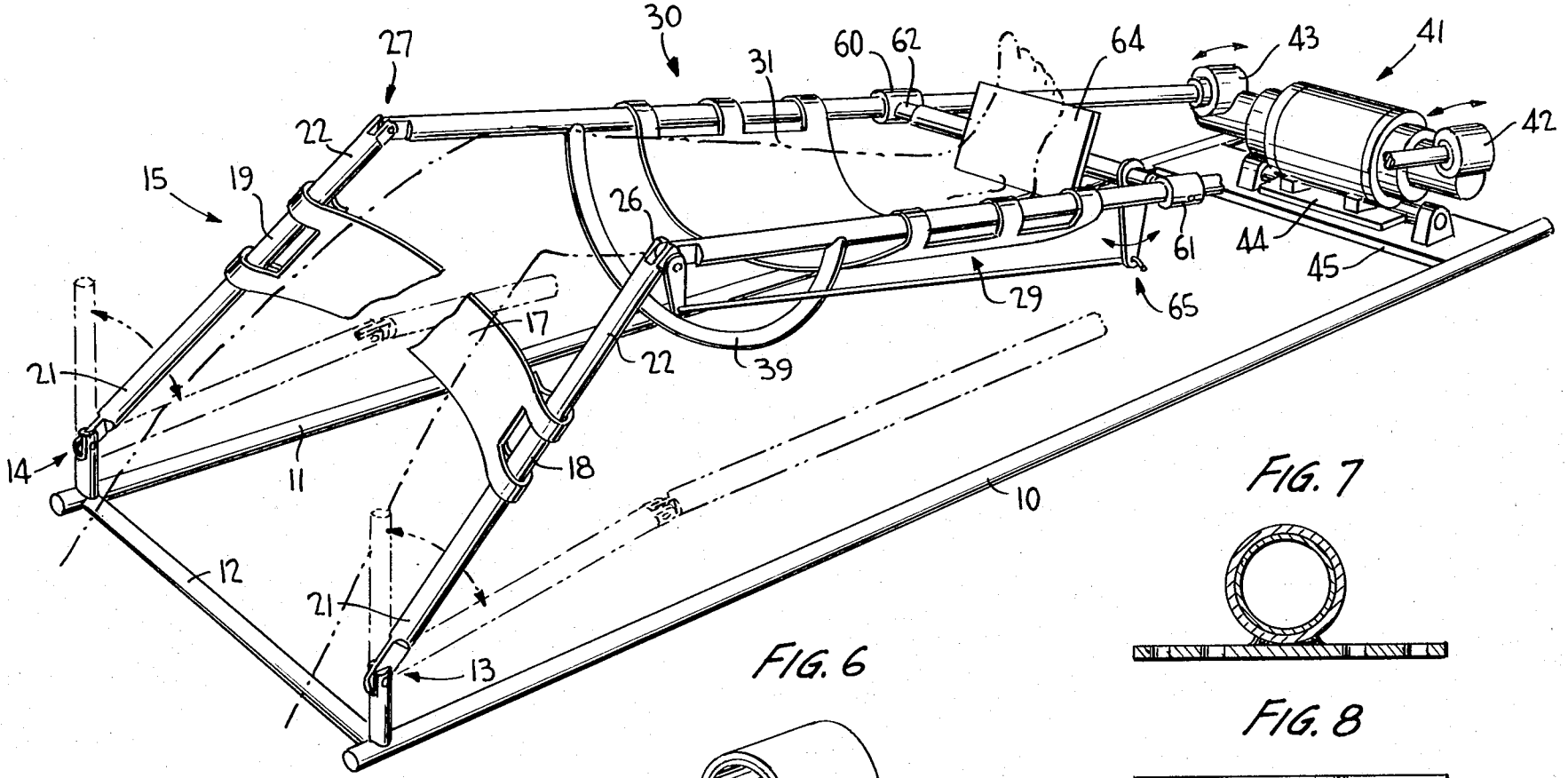
FIG. 1
FIG. 7
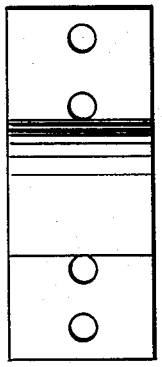
FIG. 8
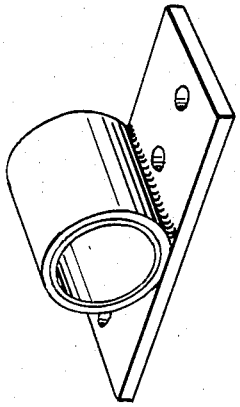
FIG. 6

KNEE EXERCISE MACHINE

BACKGROUND OF THE INVENTION

1. Technical Field

The present invention relates to exercise devices and, more particularly, to a device which passively and continuously exercises the knee of a human patient.

2. The Prior Art

Passive and continuous motion of a recently traumatized joint has been shown to have numerous advantages. These advantages include: promoting the speed and somehow the character of the repair and healing of soft tissues; promoting the healing of cartilage in the cases where articular cartilage is involved; producing much denser histolgic quality of fibrocartilage in the repair of gaps in normal articular cartilage (e.g., areas of excised osteochondral malasia); improving the range of motion of the knee joint in much shorter time, thereby shortening the recovery and convalescent time of the patient with joint problems; and decreasing the risk of deep vein thrombosis post-operatively in the case of total knee replacement or major injuries of the knee or soft tissue repair. The concept of passive and continuous motion is not a new one; however, it has only been tried sporadically in the past. Over the past few years, widespread work in this area has triggered the interest of many surgeons. New machines which provide such motion have been marketed, but a study of available machines indicates that none are complete and that many faults are involved with individual machines.

OBJECTS AND SUMMARY OF THE INVENTION

It is a primary object of the present invention to provide a compact, powerful and long-lasting exercise device to permit passive exercise of the knee.

It is another object of the present invention to provide a passive knee exerciser which is safe for use by patients at home without attending physicians.

It is another object of the present invention to provide a passive knee exercise device which can be controlled over a wide range of knee flexure and velocity of movement while accommodating various limb sizes.

It is still another object of the present invention to provide a passive knee exercise device which is simple to operate for the attending physician and patient.

In accordance with the present invention, a passive knee exercise device is adapted to rest on a bed whereby the patient can support his leg on a leg support member with his knee bent over one end of the leg support member. The leg support member is cyclically extended and retracted from its opposite end to flex the knee on a continuous and repetitive basis. Controls are provided for the speed of movement as well as the maximum and minimum flexure for any exercise.

In the preferred embodiment, the knee exerciser consists of a thigh splint, a leg splint, a foot support, a frame and a power source. A splint, in this regard, is an assembly of two telescoping mechanisms between which a sling is supported. The thigh splint or support is hinged to the leg splint or support about an axis which is horizontal and free to move in a vertical sense. The proximal end of the thigh splint is hinged to the frame and the distal end of the leg splint is hinged to a gear box for the driving motor. A high helix screw is driven from the motor gear box in a rotational sense and threadedly engages the interior of a tube which is secured to the pivot joint between the leg and thigh splints. Rotation of the screw causes the tube to telescope longitudinally with respect to the screw. When the leg splint increases in length, the hinge between the leg and thigh splints is caused to bend and thereby flex the knee. The direction of movement is cyclically changed by changing the rotational direction of the motor whereby the leg piece alternately shortens and lengthens to thereby flex and straighten the patient's knee in alternation.

A foot piece is hinged to the side splint to correspond to the tibiotalar joint and thereby provide alternate dorsi-and-plantar flexion of the foot and ankle joint.

Control over the operation of the exerciser is achieved by a command module and a remote control switch. The command module permits selection of the maximum and minimum flexion points in the repetitive exercise cycle. A speed control is provided to permit variation in the motor speed and thereby control over the speed of extension and retraction of the leg splint.

BRIEF DESCRIPTION OF THE DRAWINGS

These and other objects, features and many of the attendant advantages of the invention will be better understood upon a reading of the following detailed description when considered in connection with the accompanying drawings wherein like parts in each of the several figures are identified by the same reference numerals, and wherein:

FIG. 1 is a view in prespective of a knee exercise apparatus constructed in accordance with the present invention;

FIG. 6 is a view in perspective of a motor pivot bearing employed in the motor mount assembly of FIG. 5;

FIG. 7 is a view in transverse section of the pivot bearing of FIG. 6;

FIG. 8 is a top view of the pivot bearing of FIG. 6;

DESCRIPTION OF THE PREFERRED EMBODIMENTS

Figure 2:
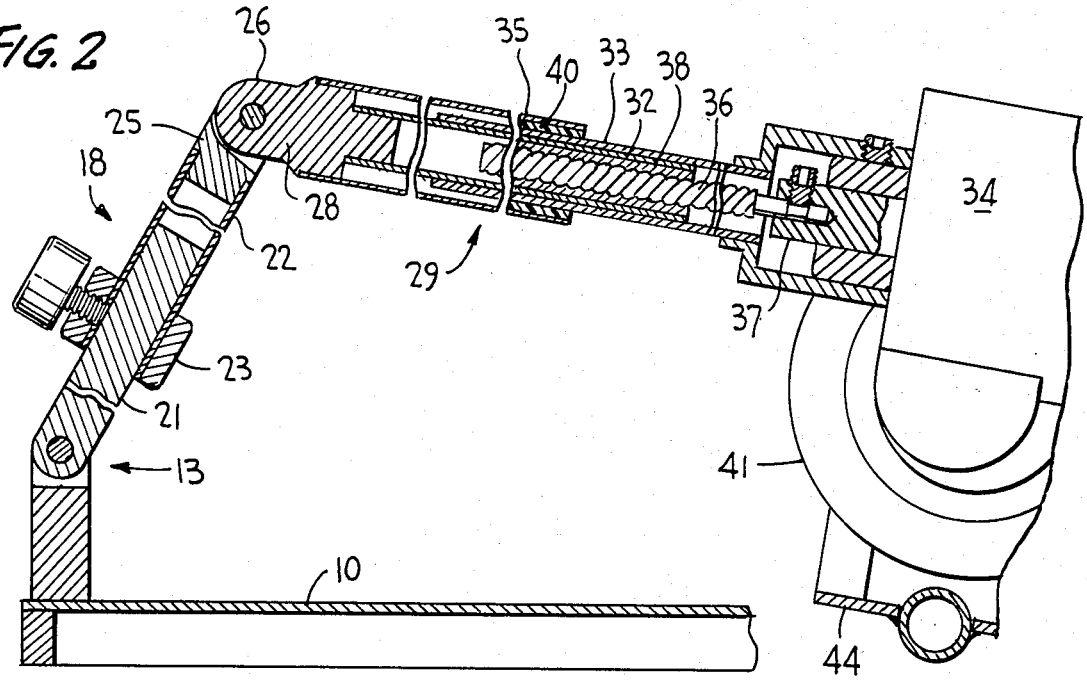
FIG. 2 is a broken view in section of the telescoping mechanism comprising the thigh and leg splints of the apparatus of FIG. 1.
Figure 3:
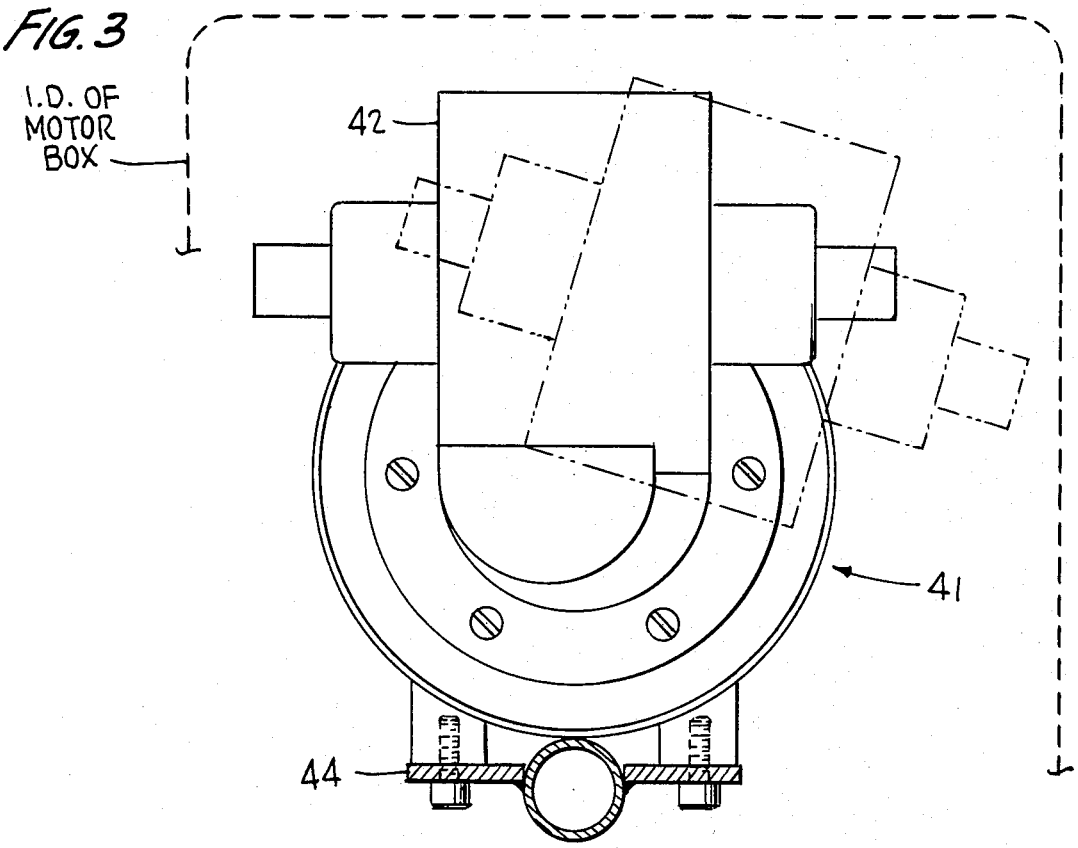
FIG. 3 is an end view of a portion of the motor mount assembly of the apparatus of FIG. 1.
Figure 4:
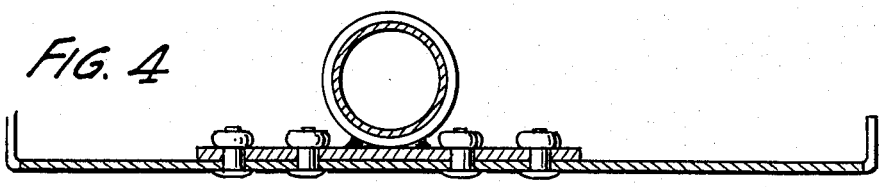
FIG. 4 is a view in section of the motor pivot bearing portion of the motor mount assembly of the apparatus of FIG. 1.
Figure 5:
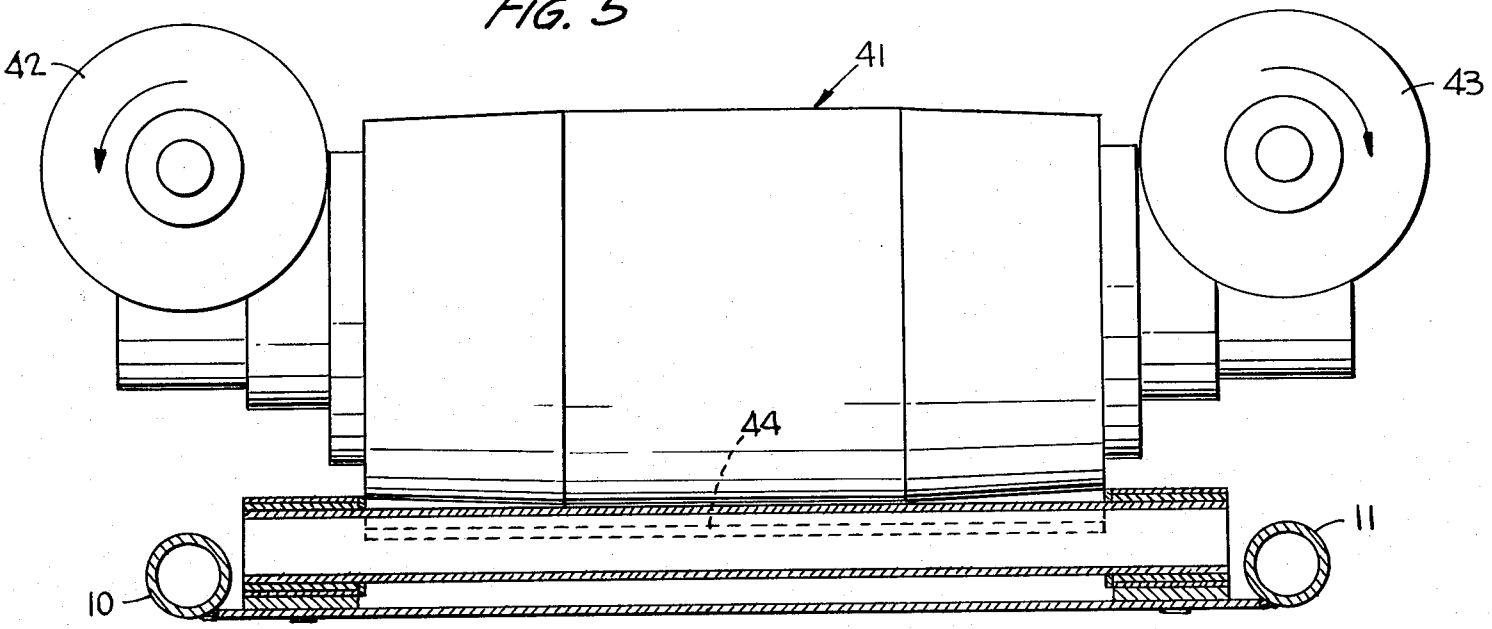
FIG. 5 is an end view in partial section of the motor mount assembly of the apparatus of FIG. 1.
Figure 10:
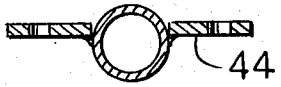
FIG. 10 is a view in transverse section of the pivot plate of FIG. 9.
Figure 11:
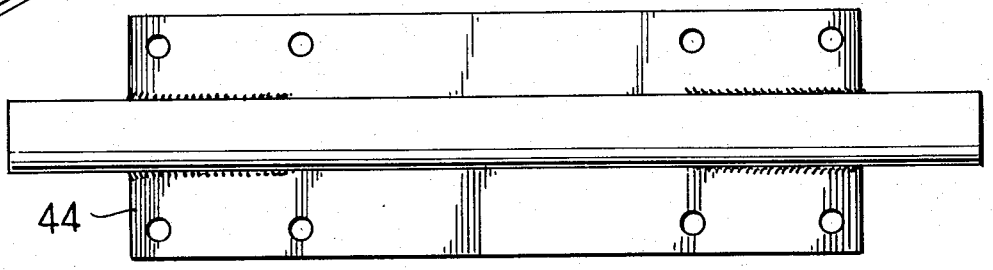
FIG. 11 is a top view of the pivot plate of FIG. 9.
Figure 9:
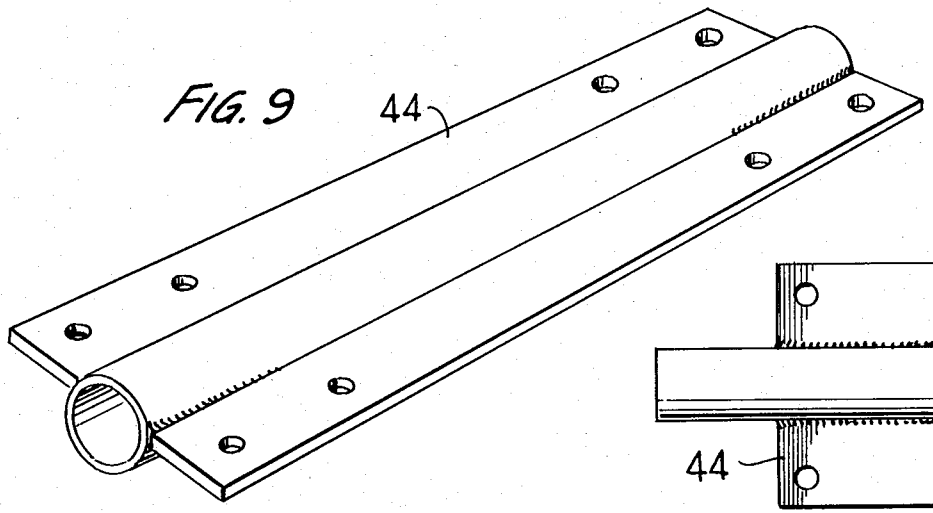
FIG. 9 is a view in perspective of the motor pivot plate employed in the assembly of FIG. 5.
Figure 12:
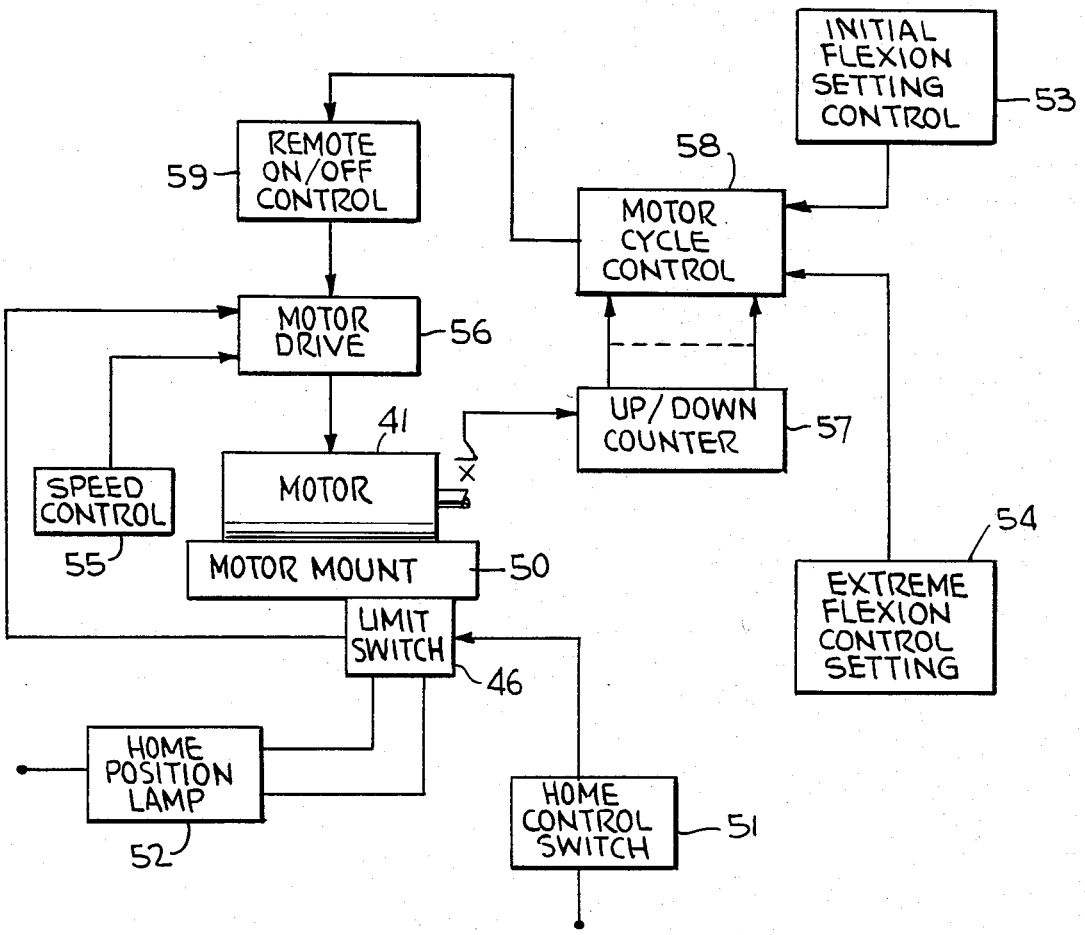
FIG. 12 is a block diagram of the electronic command module for the apparatus of FIG. 1.

Referring to the accompanying drawings in greater detail, a frame, which is adapted to lie flat on a bed, comprises a pair of parallel, elongated pipes 10 and 11 which are joined at the proximal end of the frame by a transverse pipe 12. Hinge members 13, 14 are secured to and extend above respective pipe members 10 and 11 at the proximal end of the frame. A thigh support member 15 includes first and second telescoping mechanisms extending parallel to one another, between which extends a sling member 17. The two telescoping thigh mechanisms 18 and 19 each include a bar 21 hinged at its proximal end to hinge 13 (or 14 for mechanism 19). Bar 21 is telescopically received in a tube 22 which is surrounded by a collar 23 at its proximal end. A lock screw 24 can be selectively inserted through the collar to lock the relative position of extension between bar 21 and tube 22. In this manner, the length of the thigh support member can be adjusted to accommodate varying size limbs. Typically, the length of the thigh support member would be variable over a range of from nine inches to thirteen inches. The distal end of tube 22 is secured to a male member 25 of a floating hinge 26. Hinge 13 and hinge 26 permit pivoting of their respective hinged components about parallel axes; it is noted that the axes of pivot are horizontal, that the axis of hinge 13 is fixed with respect to the frame but, as we will see from the following description, the axis of hinge 26 is movable vertically. A corresponding hinge 27 is provided for telescoping mechanism 19 of the thigh support member.

The female portion 28 of hinge member 26 is secured to one telescoping mechanism 29 of the leg support member, the latter including a second telescoping mechanism 30 which is parallel and spaced apart from mechanism 29. An adjustable sling 31 is suspended between the two mechanisms 29 and 30. The two telescoping mechanisms 29 and 30 are substantially identical and only mechanism 29 will be described in the following paragraph.

The leg support member is the portion of the apparatus which provides motion to effect the knee exercise. The driving mechanism is completely contained in the leg support mechanism which comprises three precision tubes arranged to telescope with respect to one another with a slip-fit tolerance. A first tube 32 is designated as an inner tube or screw receiving tube and is secured by welding or like to the female member 28 of the floating hinge 26. A second tube 33, which is designated the middle or screw cover tube, is secured to the gear box 34 of the drive motor assembly at the distal end of tube 33. As clearly illustrated, tube 33 has its proximal end disposed about the screw receiving tube 32 which slides longitudinally within tube 33. The third or outer tube 35 is also designated as the leg section frame tube. A high helix screw 36 has its distal end secured within gear box 34 to a drive shaft 37. Screw 36 extends into the screw receiving tube 32 where it is threadedly engaged by an elongated nut 38. The nut is typically is two inches long and is fixed into the tip of the tube by special key plugs. More specifically, tube 32 is provided with two oval holes or key ways, one on each side of the tube and located approximately one quarter inch from the distal end of tube 32. Perpendicular to the axis of the center of this hole is a long key way (for example, one inch long). Two keys are provided at the periphery of nut 38 and project radially into the key ways. The height of such key is equal to the thickness of the tube 32. During assembly, nut 38 is forced into tube 32 and the keys are placed within the holes. The tip of the key way is then welded together so that the nut and key are captured inside the hole. The key is fit into the key way with an interference fit to lock the nut and prevent rotation and translation. In addition, a lock tight solution may be applied during assembly.

As screw 33 is rotated by drive shaft 37, the screw enters nut 38 and screw receiving tube 32 while the middle or screw cover tube 33 telescopes over the screw receiving tube 32 and into the outer tube 35. Rotation of the screw 33 moves the nut 38 distally and proximally, depending upon the direction of rotation of the shaft 37. In other words, the outer tube 35 and inner tube 32 act as a single unit as the screw rotates and pushes them proximally or pulls them distally with respect to the patient. The two outer tubes 35 of respective telescoping mechanism 29, 30 of the leg splint are linked together by a curved tube 39 welded to each of the outer tubes 35. The sling 31 has an adjustable slack feature whereby it can be raised so that the patient's leg does not rest on the cross support tube 39. A Teflon bushing 40 is fixed into the distal end of outer tube 35 to provide a low friction and high efficiency movement of the outer tube about the middle tube 33. Bushing 40 is fixed in place by means of lock tight and by crimping the distal tip of outer tube 35.

The motor assembly 41 is fixed to the most distal end of the frame and is attached to the leg splints by means of respective gear boxes 42, 43. The gear boxes contain reduction gears to reduce the speed of drive shaft 37 relative to the actual motor revolution speed.

The motor assembly 41, with gear boxes 42 and 43 connected to either side, is placed at the distal end of the frame so that the output shafts of the gear boxes extend into the respective telescoping mechanisms of the leg splints. The output shafts of the gear boxes are secured to the distal end of the high helix screw at the distal end of the leg splints. The gear boxes 42, 43 are secured to the middle or screw cover tube 33. The axes of the two output shafts 37 are aligned with the axis of the high helix screw and the axes of the three tubes 32, 33 and 35. The motor assembly 41 is secured to a tilting panel 44 which is pivotally mounted relative to a base plate 45. The base plate is welded or otherwise secured to the distal ends of the two frame tubes 10 and 11. This permits the motor assembly to pivot as the length of the leg splint mechanisms 29 and 30 change in length and thereby change their angular orientation with respect to the horizontal frame. An electrical limit switch unit 46 is mounted on the base plate so as to be contacted by the tilting plate 44 which operates in conjunction with the electrical control arrangement for the system to stop the motor at a predetermined home position of the exerciser. In this home position, the leg splint is substantially horizontal while the thigh splint forms a seven degree angle (approximately) with the horizontal in a direction toward its distal end. This small angle of the thigh joint relative to horizontal in the home position makes it possible for the mechanism to push the hinge 26, 27 from the home position without locking of the hinge against axial thrust. If the leg and thigh splints were both horizontal in the home position, the axial thrust would tend to push both splints axially with the possible rupture of one or both hinges 26 and 13 (or 27 and 14). The initial seven degree angle of flexion for the mechanism can be compensated for at the knee of the patient by loosening the sling 17 for the thigh support member and tightening the sling 31 for the leg support member as necessary.

The control of the apparatus is provided by a command module illustrated in block diagramatic form. The motor 41 rests on a motor mount generally designated by the reference numeral 50. The limit switch 46 is disposed beneath the motor mount as described hereinabove. A home control switch 51, which is selectively actuated by the operator acts to bring the machine to its home position from any given position when this switch is actuated. In addition, when the exerciser is in its home position, the home position lamp 52 is lit. As indicated above, the home position refers to that position wherein the machine comes to full extension of the knee joint and the leg and thigh become parallel to the frame and stay horizontal. As noted above, in this position, the thigh splint makes a small acute angle with respect to horizontal. When the machine is in its home position, the attendant can select start and stop angles for the knee exercise cycle by means of the initial flexion setting control 53 and the extreme flexion setting control 54. The initial flexion setting control is calibrated from zero degrees to 100 degrees so that the attendant can set the starting knee flexion to any of these angles. The extreme flexion control is calibrated between 10 degrees and 120 degrees. A motor speed control 55 permits independent control over the motor speed by means of the motor drive circuit. The speed control 55 is calibrated in speeds for one cycle of motion (i.e. a cycle of motion being defined as movement from initial flexion through extreme flexion and back to initial flexion). Calibration of the speed control is in units of one cycle per ten minutes to one cycle per ten seconds. This control varies the angular velocity of the motor and not its cycle frequency. Therefore, the cycle frequency will be dependent upon the total range of motion per cycle and the angular velocity setting at speed control 55. The flexion position of the exerciser is registered by an up/-down counter 57 which is arranged to count revolutions of the motor drive shaft via a magnetic sensor or the like. The setting control 53 and 54 provide preset numbers into the motor cycle control unit 58 which responds when the up/down counter attains a count corresponding to the preset numbers. When the count in counter reaches either the initial or extreme flexion settings, the motor direction is changed via the motor cycle control unit 58 acting through the remote on/off control switch unit 59. The on/off control unit 59 permits the patient to have ultimate control of starting or stopping the operating cycle. The on/off control unit controls the motor drive unit 56 to control the motor 41.

In operation, the attending physician or other medical personnel first brings the apparatus to the home position by pushing and holding the home control switch 51 in the on state until the home position indicator lamp 52 lights. Then, by appropriately adjusting the initial and extreme flexure controls 53 and 54, the initial and extreme flexion positions are set. The on switch at the remote control unit 59 can then be actuated to start the exerciser from its home position to begin flexure to the maximum flexion setting. The exerciser, upon reaching this maximum flexion, returns to the minimum flexion and cycles back and forth between these two points. The remote control switch 59 operates at a low voltage and current to provide a high degree of safety for the patient while providing the patient the choice of stopping the machine at any point in the cycle and starting it again when the patient desires to do so.

The foot piece mechanism includes two small tubes 60, 61 which fit slidably over the outer tubes of the leg splint mechanisms. These small sliding tubes or cuffs are joined by a fixed transverse tube 62 about which a collar 63 is rotatably positioned. A foot plate 64 is secured to the freely rotatable tube 63. In addition, a linkage 65 is connected between the freely rotatable tube 63 and the distal end of the knee hinge 26. This linkage causes dorsiflexion and plantarflexion of the foot in synchronization with the flexion and extension of the knee.

The slings 31 and 17 are made of strong polyester material and are attached with a number of Velcro closures which allow the attending physician or other mdeical personnel to adjust their tautness. The padding for the sling is provided in a way to provide more comfort for the patient while the slings adjust themselves to the machine. The upper portion of the padding is preferably made of sheep wool with a 2-layer lining of satin. These two layers of satin can slide freely on one another. Under the second layer of satin, there is a layer of soft foam approximately one half inch thick. Under this is a polyester material with Velcro fasteners underneath which attach to the straps, themselves made of Velcro. This arrangement allows the padding to slide between two satin linings while the wool skin is disposed underneath so that is no movement between the wool skin and the skin of the patient. This provides more protection for the patient's skin which is not available in other exerciser machines. The padding can then be placed under the sling over the thigh splint and leg splint. This is in one piece and provides a good padding under the knee and in the ankle area. Velcro between the aforesaid layers of padding and the sling act to hold the padding in place at all times.

Having described a preferred embodiment of a new and improved exerciser device constructed in accordance with the present invention, it is believed that other modifications, variations and changes will be suggested to those skilled in the art in light of the above teachings. It is, therefore, to be understood that all such variations, modifications and changes are believed to come within the scope of the invention as defined in the appended claims.

What is claimed is:

1. An automatic knee exerciser comprising:

a frame;

a thigh support member having proximal and distal ends;

a leg support member having proximal and distal ends;

a motor assembly;

means connecting said proximal end of said thigh support member to said frame for pivotal movement about a first horizontal axis which is fixed relative to said frame;

means rigidly connecting said distal end of said leg support member to said motor assembly;

means mounting said motor assembly on said frame for pivotal movement about a second horizontal axis which is fixed relative to said frame and located in spaced parallel relation to said first horizontal axis;

pivot means joining the distal end of said thigh support means to the proximal end of said leg support means for mutual pivotal motion about a third horizontal axis which is movable relative to said frame and located in spaced parallel relation to said first and said second horizontal axes;

actuator means drivingly interconnected to said motor assembly and thereby providing a driving force applied to said leg support member for selectively axially extending and retracting said leg support member to move said pivot means and said third horizontal axis and to thereby cause said leg support member to pivot with respect to said thigh support means about said third horizontal axis;

said leg support member including a first elongated member secured to said pivot means so as to move therewith and further movably interconnected to said actuator means so as to move relative thereto;

said first elongated member and said actuator means attached in coaxial relation to one another along a common longitudinal axis thereof and relatively disposed to apply said driving force along said common longitudinal axis.

2. The exerciser according to claim 1 wherein said actuator means is positioned at least in part in enclosed relation within said leg support member and said common longitudinal axis is disposed in transverse relation to said third horizontal axis.

3. The exerciser according to claim 1 wherein said first elongated member includes a threaded bore extending longitudinally of said leg support member;

wherein said actuator means includes an elongated screw member having a first end secured to said motor assembly and a second end which extends into said threaded bore, said screw member having a threaded periphery which is threadedly engaged in said threaded bore to move said screw in and out of said bore in response to rotation of the screw; and wherein said motor assembly includes a drive shaft which is rotatable about a rotation axis extending longitudinally of said leg suport member, and means for securing said drive shaft to said screw member to rotatably drive said screw member about said rotation axis.

4. The exerciser according to claim 3 further comprising means for operating said motor to cyclically rotate said drive shaft in different directions.

5. The exerciser according to claim 4 further comprising means to selectively vary the speed of rotation of said drive shaft.

6. The exerciser according to claim 4 further comprising means for automatically rotating said drive shaft a predetermined number of turns in each direction, cyclically, and means for selectively varying said predetermined number of turns.

7. The exerciser according to claim 3 wherein said leg support member further comprises a second elongated member rigidly secured to said motor assembly, extending longitudinally toward said third horizontal axis and surrounding said screw member and variable length portions of said first elongated member.

8. The exerciser according to claim 7 wherein said leg support member includes a third elongated member secured to said pivot means, extending longitudinally toward said motor assembly and surrounding portions of said first and second elongated members.

9. The exerciser according to claim 8 wherein said first, second and third elongated members are concentrically disposed tubes.

10. The exerciser according to claim 9 wherein said first elongated member includes an elongated nut member secured internally thereof, said nut member being internally threaded to define said threaded bore for receiving said screw member.

11. The exerciser according to claim 3 wherein said first elongated member includes an elongated nut member secured internally thereof, said nut member being internally threaded to define said threaded bore for receiving said screw member.

12. The exerciser according to claim 1 further comprising means for selectively varying the length of said thigh support member.

13. The exerciser according to claim 1 wherein said thigh support member and said leg support member each includes two spaced parallel elongated members and a sling extending extending between said elongated members to support the thigh and leg, respectively, of a patient between the elongated members.

14. The exerciser according to claim 13 further comprising means for selectively adjusting the tension of said slings in said thigh and leg support members.

15. The exerciser according to claim 8 wherein said actuator means is disposed in enclosed relation within said leg support member and said driving force is applied along a common axis of said elongated screw member and said first, second, and third elongated members.

* * * * *